US010201254B2

(12) United States Patent
Hudkins

(10) Patent No.: US 10,201,254 B2
(45) Date of Patent: Feb. 12, 2019

(54) TRUE ROLL

(71) Applicant: Elza Perry Hudkins, Garland, TX (US)

(72) Inventor: Rick Joe Hudkins, Garland, TX (US)

( * ) Notice: Subject to any disclaimer, the term of this patent is extended or adjusted under 35 U.S.C. 154(b) by 100 days.

(21) Appl. No.: 15/188,105

(22) Filed: Dec. 2, 2016

(65) Prior Publication Data

US 2018/0153358 A1 Jun. 7, 2018

(51) Int. Cl.
*A47K 10/22* (2006.01)
*A47K 10/16* (2006.01)
*A47K 10/40* (2006.01)

(52) U.S. Cl.
CPC ..... *A47K 10/22* (2013.01); *A47K 10/16* (2013.01); *A47K 10/40* (2013.01)

(58) Field of Classification Search
CPC ..... A47K 10/22; A47K 10/16
See application file for complete search history.

(56) References Cited

U.S. PATENT DOCUMENTS 1,399,432 A * 12/1921 Johnson ..... A47K 10/22 242/423.1
1,781,547 A * 11/1930 Hoegger ..... A47K 10/22 242/575.3
2,253,664 A * 8/1941 Vigo ..... A47K 10/22 211/105.6
2,344,660 A * 3/1944 Vaughan ..... A47K 10/22 242/596.3
2,492,728 A * 12/1949 Balz ..... A47K 10/22 242/598.4
2,546,820 A * 3/1951 Grant ..... A47K 10/22 242/599.1
3,627,220 A * 12/1971 Vogel ..... B65D 85/66 242/609
4,372,500 A * 2/1983 Saraisky ..... B65H 75/185 242/557
5,908,172 A * 6/1999 Pierro ..... B65H 75/14 242/118.4
6,138,941 A * 10/2000 Miyake ..... G03B 27/588 206/397
6,883,292 B1 * 4/2005 Chen ..... B65B 11/04 53/389.1
9,622,626 B1 * 4/2017 Radke ..... A47K 10/3836
9,770,142 B2 * 9/2017 Ochoa, Sr. ..... A47K 10/16

* cited by examiner

*Primary Examiner* — Christopher R Harmon

(57) ABSTRACT

A tissue holder to hold a roll of toilet tissue may include a first toilet tissue holder to hold at a first end the roll of toilet tissue; and a second toilet tissue roll holder to hold at a second to end the roll of toilet tissue. The first toilet tissue holder may include a first tissue holder cylinder to hold the roll of toilet tissue. The second toilet tissue holder may include a second tissue holder.

5 Claims, 8 Drawing Sheets

TRUE ROLL

FIELD OF THE INVENTION

The present invention relates to toilet tissue and more particularly to a toilet tissue holder

BACKGROUND

Toilet tissues are generally used by a large population. Conventionally, a tissue holder may be a pair of opposing telescoping cylinders biased by a spring having a diameter which is generally less than the diameter of a center aperture of a roll of toilet tissue. In some cases the diameters are exceedingly different in diameter size. This results in noise and vibration when the toilet tissue is unwound over the telescoping cylinders. At times, this noise can be extremely unwanted.

SUMMARY

A tissue holder to hold a roll of toilet tissue may include a first toilet tissue holder to hold at a first end the roll of toilet tissue; and a second toilet tissue roll holder to hold at a second to end the roll of toilet tissue.

The first toilet tissue holder may include a first tissue holder cylinder to hold the roll of toilet tissue.

The second toilet tissue holder may include a second tissue holder cylinder to hold the roll of toilet tissue.

The first toilet tissue holder may include a first holding disc connected to the first tissue holder cylinder.

The second toilet tissue holder may include a second holding disc connected to the second tissue holder cylinder.

The first holding disc may include a first central holding aperture to cooperate with the telescoping cylinders.

The second holding disc may include a second central holding aperture to cooperate with the telescoping cylinders.

The first holding disc may be concavely curved.

The second holding disc may be concavely curved.

The first holding disc may include a first radial rib.

The second holding disc may include a second radial rib.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The true roll system of the present invention is a quiet roll of toilet paper, and the true roll system fills in the space between the toilet paper roll and the toilet paper holder rod (a pair of opposing telescoping cylinders) so that the true roll system will roll and operate smoothly and quietly. The true roll system eliminates the awful and distracting sound of unrolling the toilet tissue and easily and quietly unrolls the toilet paper. The true roll system of the present invention may include two injection molded polypropylene toilet tissue holders and may be safe for small children being too big to swallow and is non-toxic. The true roll system of the present invention may eliminate the undesirable tearing of toilet paper, and the true rule system may be adjusted to accommodate bigger or smaller applications.

The true roll system of the present invention may be formed into different sizes for multiple applications, and the tool roll system may be constructed from metal, wood, plastic or other types of material.

Figure 1:
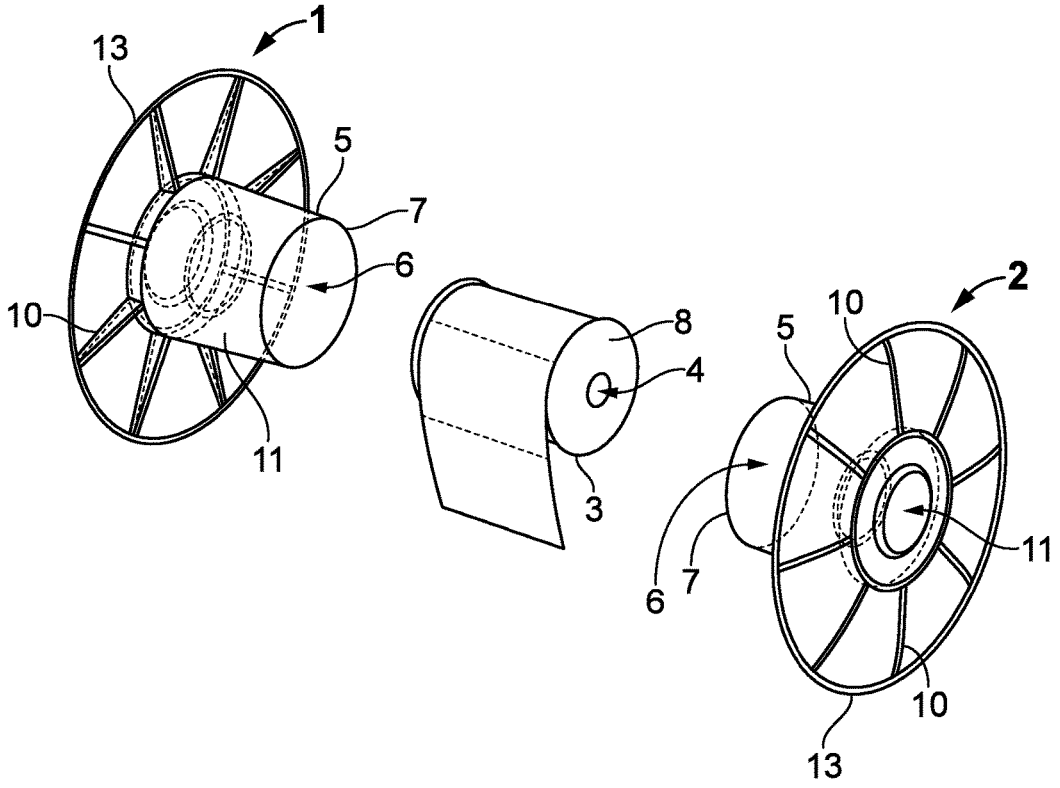
FIG. 1 illustrates an exploded view of the true roll system of the present invention.

FIG. 1 illustrates the first toilet tissue holder 1, the second toilet tissue holder 2 and the roll of toilet tissue 3 which may be a multitude of substantially rectangular tissues connected on one edge to another rectangular tissue which may be rolled over a tissue cylinder 4 to cooperate with a tissue holder shaft (not shown).

The first toilet tissue holder 1 may be a near mirror of the second toilet tissue holder 2. Each of the first toilet tissue holder 1 and the second toilet tissue holder 2 may include a holding cylinder 5 having an peripheral wall 7 defining a central holding aperture 6 which may extend through the toilet tissue holder 1, 2 having a diameter to achieve a friction fit with the outer surface of the peripheral wall 7 and with the inner surface of the peripheral wall 8 of the tissue holder cylinder 4.

FIG. 1 illustrates that the holding cylinder 5 is connected at one end to a slightly concave curved holding disc 6 (or dome) having a central disc aperture 11 which aligns with the central holding aperture 6 to cooperate with the peripheral wall 8 of the tissue holder cylinder 4. The central disc aperture 11 may have a diameter which corresponds to the smaller or larger of the telescoping cylinders. FIG. 1 additionally illustrates radial ribs 10 which may radially extend from the disc aperture 11 to the peripheral edge 13 of the holding disc 6.

Figure 2:
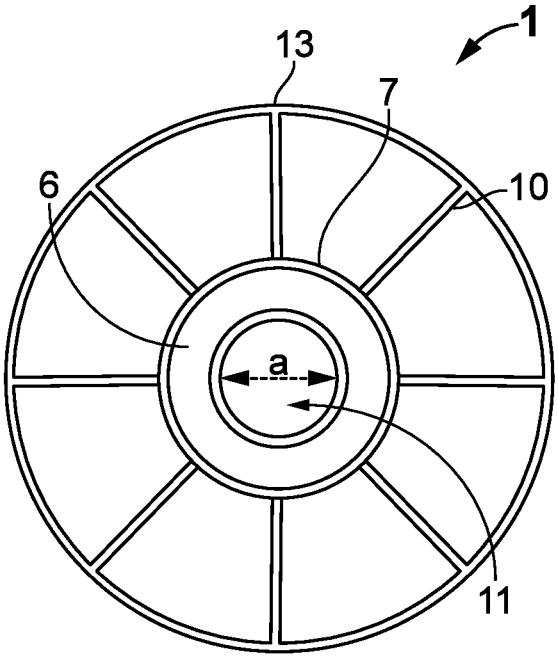
FIG. 2 illustrates an end view of a first toilet tissue holder of the present invention.

FIG. 2 illustrates an end view of a first toilet tissue holder 1 of the present invention. FIG. 2 illustrates the peripheral wall 7, the central holding aperture 6, the holding cylinder 5, the center disc aperture 11 having a diameter a that corresponds to the diameter of the smaller diameter of the telescoping cylinders and the radial ribs 10.

Figure 3:
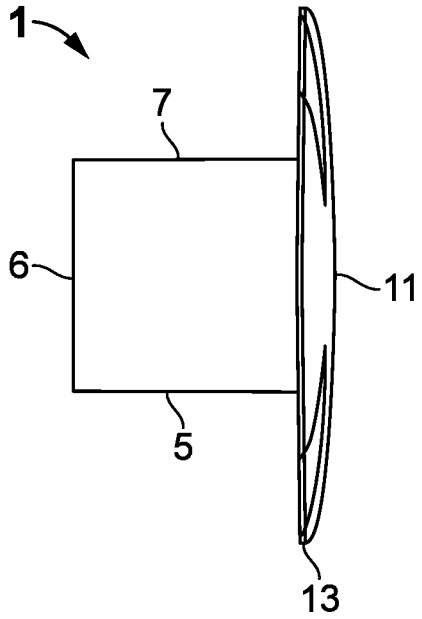
FIG. 3 illustrates a side view of the first toilet tissue holder of the present invention.

FIG. 3 illustrates a side view of the first toilet tissue holder 1 of the present invention. FIG. 3 illustrates the peripheral wall 7, the central holding aperture 6, the holding cylinder 5, the center disc aperture 11 having a diameter that corresponds to the diameter of the smaller diameter of the telescoping cylinders and the radial ribs 10.

Figure 4:
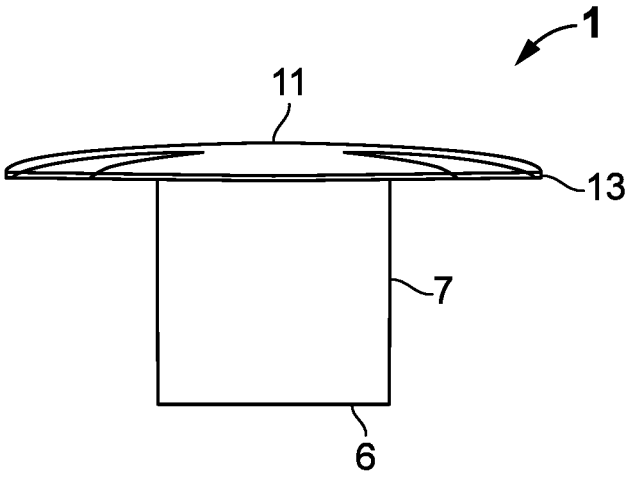
FIG. 4 illustrates another side view of the first toilet tissue holder of the present invention.

FIG. 4 illustrates another side view of the first toilet tissue holder 1 of the present invention. FIG. 4 illustrates the peripheral wall 7, the central holding aperture 6, the holding cylinder 5, the center disc aperture 11 having a diameter that corresponds to the diameter of the smaller diameter of the telescoping cylinders and the radial ribs 10.

Figure 5:
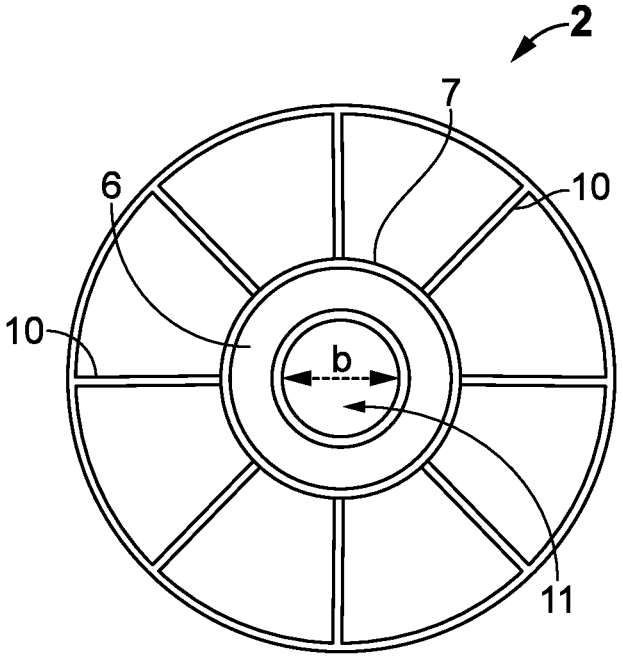
FIG. 5 illustrates an end view of the second toilet tissue holder of the present invention.
Figure 6:
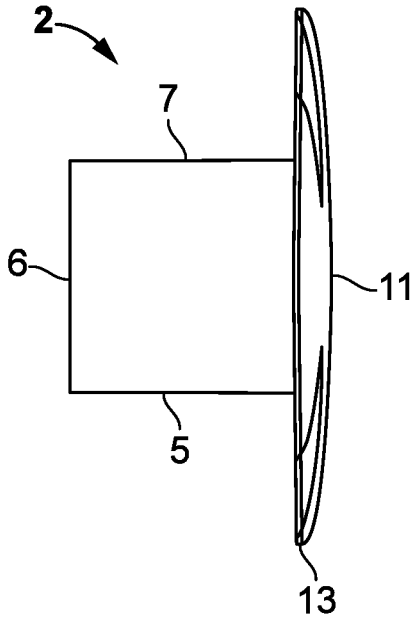
FIG. 6 illustrates a side view of the second tissue holder of the present invention.
Figure 7:
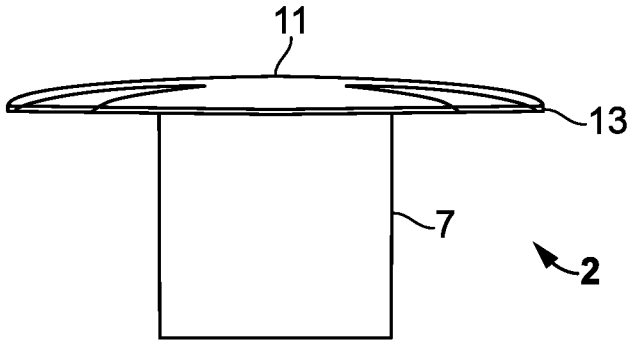
FIG. 7 illustrates a side view of the second tissue holder of the present invention.

FIG. 5 illustrates an end view of the second toilet tissue holder 2 of the present invention. FIG. 5 illustrates the peripheral wall 7, the central holding aperture 6, the holding cylinder 5, the center disc aperture 11 having a diameter b that corresponds to the diameter of the larger diameter of the telescoping cylinders and the radial ribs 10. of the present invention;

FIG. 6 illustrates a side view of the second tissue holder 2 of the present invention. FIG. 6 illustrates the peripheral wall 7, the central holding aperture 6, the holding cylinder 5, the center disc aperture 11 having a diameter that corresponds to the diameter of the larger diameter of the telescoping cylinders and the radial ribs 10. of the present invention;

FIG. 7 illustrates a side view of the second tissue holder 2 of the present invention. FIG. 7 illustrates the peripheral wall 7, the central holding aperture 6, the holding cylinder 5, the center disc aperture 11 having a diameter that corresponds to the diameter of the larger diameter of the telescoping cylinders and the radial ribs 10.

Figure 8:
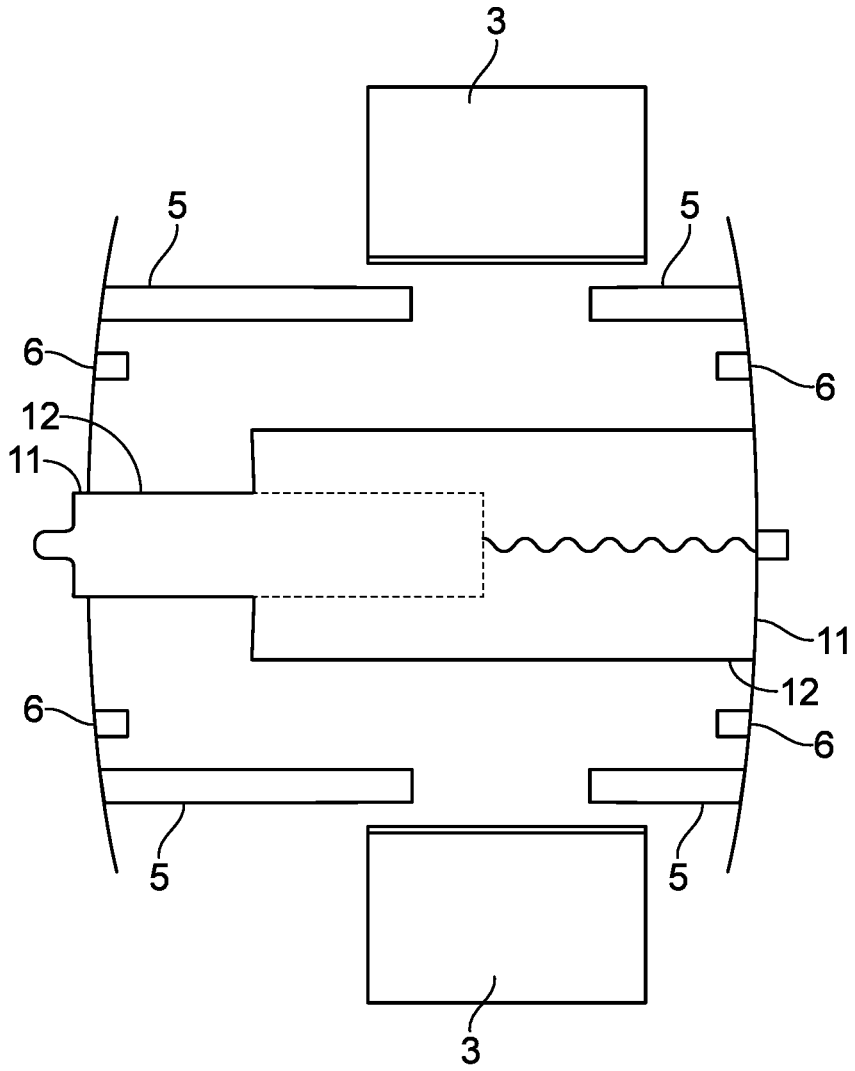
FIG. 8 illustrates a side view of the true roll system of the present invention.

FIG. 8 illustrates a toilet tissue holding rod which may include an opposing pair of telescoping cylinders 12 and the biasing device to bias the telescoping cylinders 12 which may be a spring to bias the telescoping cylinders 12, the holding disc 6 having a central disc aperture 11 to cooperate with the telescoping cylinders 12, the holding cylinder 5 to maintain the peripheral wall 8 of the tissue holder cylinder 4 in a spaced relationship to the telescoping cylinders 12 and the toilet tissue roll 3.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A tissue holder to hold a roll of toilet tissue, comprising:

a first toilet tissue holder to hold at a first end the roll of the toilet tissue;

a second toilet tissue roll holder to hold at a second end the roll of the toilet tissue;

the first toilet tissue holder having a first telescoping tissue holder cylinder to hold the roll of the toilet tissue;

the second toilet tissue holder having a second telescoping tissue holder cylinder to hold the roll of the toilet tissue;

the first toilet tissue holder having a first holding disc connected to the first tissue holder cylinder;

the second toilet tissue holder having a second holding disc connected to the second tissue holder cylinder;

the first holding disc having a first central holding aperture to cooperate with the first and second telescoping cylinders;

the second holding disc having a second central holding aperture to cooperate with the first and second telescoping cylinders.

2. A tissue holder to hold a roll of toilet tissue as in claim 1, wherein the first holding disc is concave.

3. A tissue holder to hold a roll of toilet tissue as in claim 1, wherein the second holding disc is concave.

4. A tissue holder to hold a roll of toilet tissue as in claim 1, wherein the first holding disc includes a first radial rib.

5. A tissue holder to hold a roll of toilet tissue as in claim 1, wherein the second holding disc includes a second radial rib.

* * * * *